US005328163A

United States Patent [19]

Yamada

[11] Patent Number: 5,328,163

[45] Date of Patent: Jul. 12, 1994

[54] RECORDING SHEET FEEDING DEVICE

[75] Inventor: Yasushi Yamada, Hachioji, Japan

[73] Assignee: Konica Corporation, Tokyo, Japan

[21] Appl. No.: 966,709

[22] Filed: Oct. 26, 1992

[30] Foreign Application Priority Data

Nov. 7, 1991 [JP] Japan ..... 3-291537
Nov. 7, 1991 [JP] Japan ..... 3-291538
Nov. 7, 1991 [JP] Japan ..... 3-291539

[51] Int. Cl.[5] ..... B65H 5/00

[52] U.S. Cl. ..... 271/10; 271/117; 271/124

[58] Field of Search ..... 271/10, 4, 3, 3.1, 6, 271/7, 117, 121, 124

[56] References Cited

U.S. PATENT DOCUMENTS 3,963,339 6/1976 Taylor et al. ..... 271/10 X
4,550,903 11/1985 Moore .
5,120,039 6/1992 Yamada ..... 271/4

FOREIGN PATENT DOCUMENTS 50-73374 6/1975 Japan .
58-125543 7/1983 Japan ..... 271/4
60-36248 2/1985 Japan .

*Primary Examiner*—David H. Bollinger
*Attorney, Agent, or Firm*—Frishauf, Holtz, Goodman & Woodward

[57] ABSTRACT

A sheet feeding device having a tray on which a plurality of sheets are stacked, includes a feeder for feeding the stacked sheets through contact therewith, a separator provided downstream in the feeding direction of the feeder for separating sheets one by one from the stack of sheets and at least a pair of conveyance rollers provided downstream of the separator for conveying the separated sheet. A detector detects the size of the stacked sheets. A pressing device presses the sheets, and a contact pressure between the feeder and the sheets is adjustable. A sheet edge detector provided downstream of the separator detects an edge of each of the separated sheet, and respective drivers drive the feeder, the pressing device and the conveyance rollers. A controller controls the driver. A table in which a plurality of variable and selectable pressure forces appliable by the pressing device are set according to a detected sheet size. The controller controls the driver according to a set value of the table.

32 Claims, 11 Drawing Sheets 148
11
12
10
1
2
31
7
6
3
5
91
8
9
4
41

RECORDING SHEET FEEDING DEVICE

BACKGROUND OF THE INVENTION

The present invention relates to a recording sheet feeding device for an image forming apparatus such as a copier, facsimile and printer, and more particularly relates to improvements in document conveyance in an automatic document feeder and recording sheet conveyance accommodated in a cassette or intermediate tray.

Conventionally, in an image forming apparatus such as a copier, facsimile and printer, a paper feed unit is provided that is operated in the following manner: the uppermost or lowermost sheet of a stack on a tray, cassette, or stacker is taken out, and the following sheets are taken out one by one.

For example, in order to timely transfer a toner image from a photoreceptor onto a transfer sheet, the transfer sheet is conveyed as follows: the transfer sheet is conveyed out from a paper feed cassette through a pickup roller and feed roller; the transfer sheet collides with a registration roller and is stopped at the registration roller under the condition that slack is provided to the sheet; the registration roller is driven synchronously with the start of a scanning operation of an optical system that reads document information; and then the transfer sheet is held by the registration roller so that it can be conveyed to the transfer region. In the case of a paper conveyance device disclosed in Japanese Patent Application Open to Public Inspection No. 73374/1975, the paper conveyance speed is controlled in the following manner: a vacuum feeder is provided in the device; a thickness detection lever and pressure detection lever that are displaced in accordance with the thickness and pressure of papers are provided to detect the thickness and pressure; and a motor to convey the papers is driven according to the results of the detection.

In a recording paper refeed device provided in an intermediate tray in the case of two-side recording or multirecording, recording papers are supplied and conveyed in the same manner as described above.

In an automatic document feeder, document sheets (referred to as a document, hereinafter) are conveyed out from a stack tray by a sheet feed device one by one; the document is conveyed onto a platen by a conveyance belt; the document is exposed by an exposure lamp; and then the document is conveyed onto a document discharge tray. According to a bottom sheet separation and conveyance device disclosed in Japanese Patent Application Open to Public Inspection No. 36248/1985, compressed air generated by an air injection means is supplied between the sheets in order to separate them. In this device, the air flow amount is controlled according to the amount of stacked sheets.

In a high speed copier that can copy at a high speed of not less than 50 sheets per minute, it is necessary to provide an automatic document feeder that can quickly and positively convey a document onto a platen glass, and further it is necessary to provide a recording paper feed device that can send a transfer sheet from a paper cassette or an intermediate tray at high speed. In the aforementioned automatic document feeder and recording sheet feed device, a large number of documents and recording sheets stacked on a tray must be positively conveyed at high speed without failure. Conveyance conditions are different according to the size and amount of documents or recording sheets to be conveyed. Therefore, conveyance tends to become unstable.

In order to prevent the aforementioned problems, a paper feed device provided with a vacuum belt or a vacuum feeder has been proposed. However, the mechanism of the aforementioned device is complicated and large-scale, and further noises are caused by the device. In the case of the aforementioned paper conveyance device disclosed in Japanese Patent Application Open to Public Inspection No. 73374/1975, the sheet pressing force can be changed only in 2 stages, therefore the device is not suitable for the complicated conveyance operation described above.

SUMMARY OF THE INVENTION

It is a primary object of the present invention to provide a recording sheet feeding device by which the aforementioned problems caused in an automatic document feeder and recording sheet conveyance device can be solved, and more specifically an object of the present invention is to provide a recording sheet feeding device in which sheet pressing force can be automatically changed in accordance with the size, material and number of recording sheets, so that sheets can be stably conveyed at high speed. Further, according to the present invention, an operator can specify the pressing force in accordance with various conveyance conditions so as to convey sheets stably.

The first structure of the invention is a recording sheet feeding device composed of a stack tray holding a plurality of sheets, a conveyance means to convey a sheet out of the stack tray, a separation means disposed downstream of the conveyance means to separate sheets, and a paper feed unit disposed downstream of the separation means, said paper feed unit having at least a pair of conveyance rollers so as to convey the separated sheet, wherein said recording sheet feeding device comprises: a sheet size detection means that detects the size of a sheet stacked on the stack tray, and generates a signal; a press means that changes contact pressure between the conveyance means and the sheet; a sheet detection means disposed downstream of the separation means, said sheet detection means capable of detecting the edge of a separated sheet; a drive means to drive the conveyance means, the press means, and the conveyance roller; and a control means to control the drive means, wherein a press force setting table is previously provided in which a plurality of variable press forces can be selected in accordance with a sheet size detection signal detected by the sheet size detection means, and the drive means is controlled in accordance with the press force setting table value.

The second structure of the invention is a recording sheet feeding device comprising: a sheet condition input means that can be set before a sheet conveyance operation is started; a sheet size detection means that detects the size of a sheet stacked on the stack tray and generates a signal; a press means that can change the contact pressure between the conveyance means and the sheet; a sheet detection means disposed downstream of the separation means, said sheet detection means being capable of detecting the edge of the separated sheet; a drive means that drives the conveyance means, the press means, and the conveyance roller; and a control means that controls the drive means, wherein the drive means is controlled in accordance with an input signal sent from the sheet condition input means.

The recording sheet feeding device of the third structure of the invention comprises: a sheet size detection means that detects the size of a sheet stacked on the stack tray, and generates a signal; a press means that changes contact pressure between the conveyance means and the sheet; a sheet detection means disposed downstream of the separation means, said sheet detection means capable of detecting the edge of a separated sheet; a drive means to drive the conveyance means, the press means, and the conveyance roller; a control means to control the drive means; a measurement means to measure a period of time from the start of a feeding operation conducted by the conveyance means, to the detection of a leading edge of a sheet conducted by the sheet detection means; and a comparison means to compare a reference value that has been previously set, with a value measured by the measurement means, wherein a comparison is made between the measured value and the reference value, and in the case where the difference is larger than a predetermined value, the pressing force applied by the press means is changed in the feeding of the subsequent sheet to be fed.

The recording sheet feeding device of the fourth structure of the invention comprises: a stack tray on which a plurality of sheets are stacked; a conveyance means to convey the stacked sheet; a movable press member that is disposed at least in a portion of the stack tray and supports the sheets and presses the sheets against the conveyance means; a drive member to move the press member through a resilient member; a drive source to drive the drive member; a first detection member that can detect a deformation amount of the resilient member, or the relative positions of the movable press member and the drive member; a separation means that is disposed downstream of the conveyance means and separates the sheets one by one; a second detection member that is disposed downstream of the separation means and detects the end portion of a separated sheet; and a control means that controls the conveyance means and the drive means.

The recording sheet feeding device of the fifth structure of the invention comprises: a stack tray on which a plurality of sheets are stacked; a movable press member that presses the conveyance means against a sheet; a drive member to move the press member through a resilient member; a drive source to drive the drive member; a first detection member that can detect a deformation amount of the resilient member, or the relative positions of the movable press member and the drive member; a separation means that is disposed downstream of the conveyance means and separates the sheets one by one; at least a pair of conveyance rollers that are disposed downstream of the separation means and convey separated sheets; a second detection member that is disposed downstream of the separation means and detects the end portion of a separated sheet; and a control means that controls the conveyance means, the drive means, and the conveyance roller.

The sixth structure of the invention is to provide a recording sheet feeding device composed of a stack tray holding a plurality of sheets, a conveyance means to convey a sheet out of the stack tray, a separation means disposed downstream of the conveyance means so as to separate a sheet, and a paper feed unit disposed downstream of the separation means, said paper feed unit having at least a pair of conveyance rollers to convey the separated sheet, wherein the conveyance means includes a rotational member, a press member capable of pressing a sheet against the rotational member, a drive member to press the press member through a resilient member, and a drive means to drive the drive member, wherein the recording sheet feeding device comprises: a sheet size detection means that detects the size of a sheet on the stack tray and generates a signal; at least one first detection means that detects the relation between the press member and the drive member; a control means to control the drive member; a second detection means capable of detecting an initial position of the press member at which a sheet can be loaded between the rotational member and the press member; a third detection means that is disposed downstream of the separation means and detects the end portion of a separated sheet; and a measurement means that measures a drive amount of the drive means from the start of drive or the detection signal of the second detection means, to the detection of the first detection means, and the total thickness of stacked sheets is detected according to the measured value obtained by the measurement means.

DETAILED DESCRIPTION OF THE PREFERRED EMBODIMENTS

Example

With reference to the attached drawings, an example of the present invention will be explained below.

Figure 1:
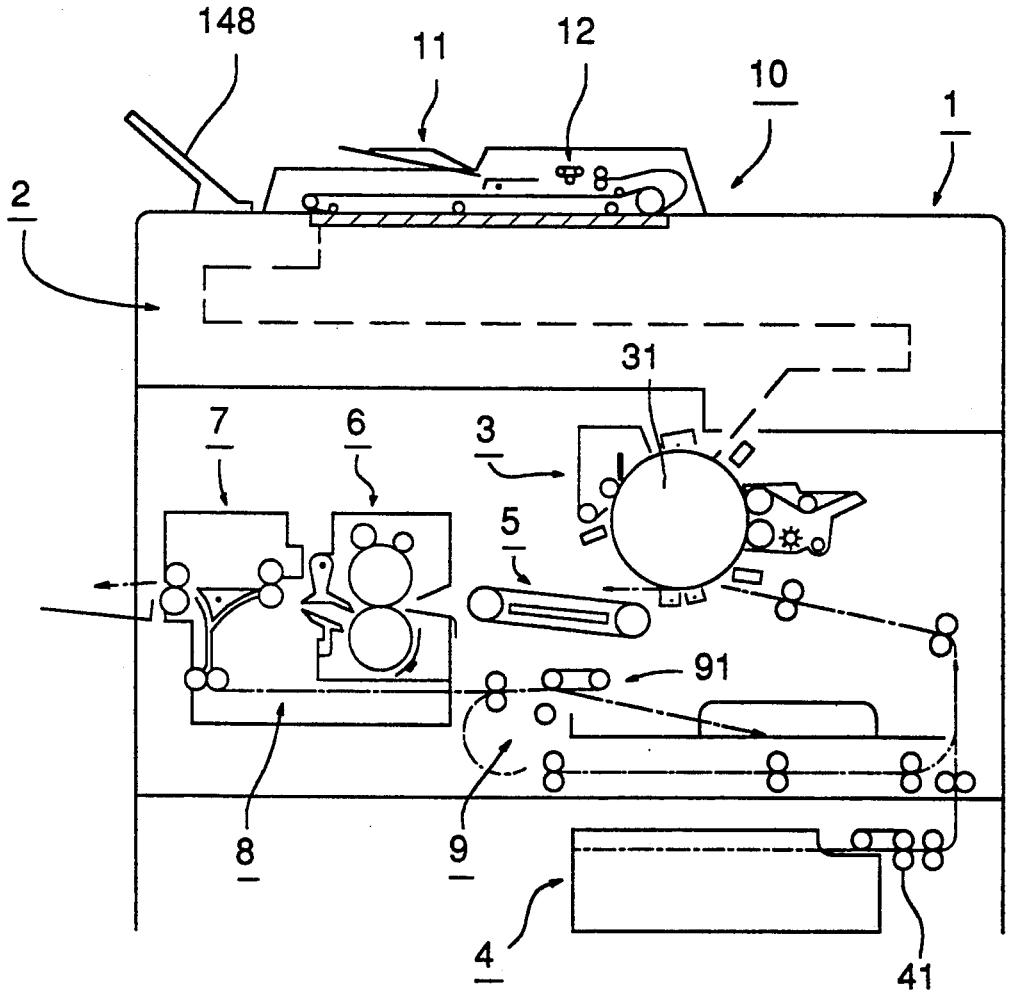
FIG. 1 is a schematic illustration showing the entire structure of an image forming apparatus to which the recording sheet feeding device of the present invention is applied.

FIG. 1 is a schematic illustration showing the entire structure of an image forming apparatus (a copier) to which the recording sheet feeding device of the present invention is applied.

In FIG. 1, numeral 1 is a copier body, numeral 2 is an optical scanning exposure system, numeral 3 is an image forming means disposed around a photoreceptor drum 31, numeral 4 is a supply means for copy papers (a paper supply means), numeral 5 is a copy paper conveyance means, numeral 6 is a fixing unit, numeral 7 is a reverse discharged paper switching means, numeral 8 is a reverse conveyance means, numeral 9 is a two-side-recording paper conveyance means (ADU), and numeral 10 is an automatic document feeder (ADF) having two-side-document automatic reversing function.

Paper feeding section 41 of the copy paper supply means 4, paper feeding section 91 of the two-side recording paper conveyance means 9, and paper feeding section 12 of the automatic document feeder 10 are structured in the same manner. Therefore, only the automatic document feeder 10 will be explained in detail, hereinafter.

Figure 2:
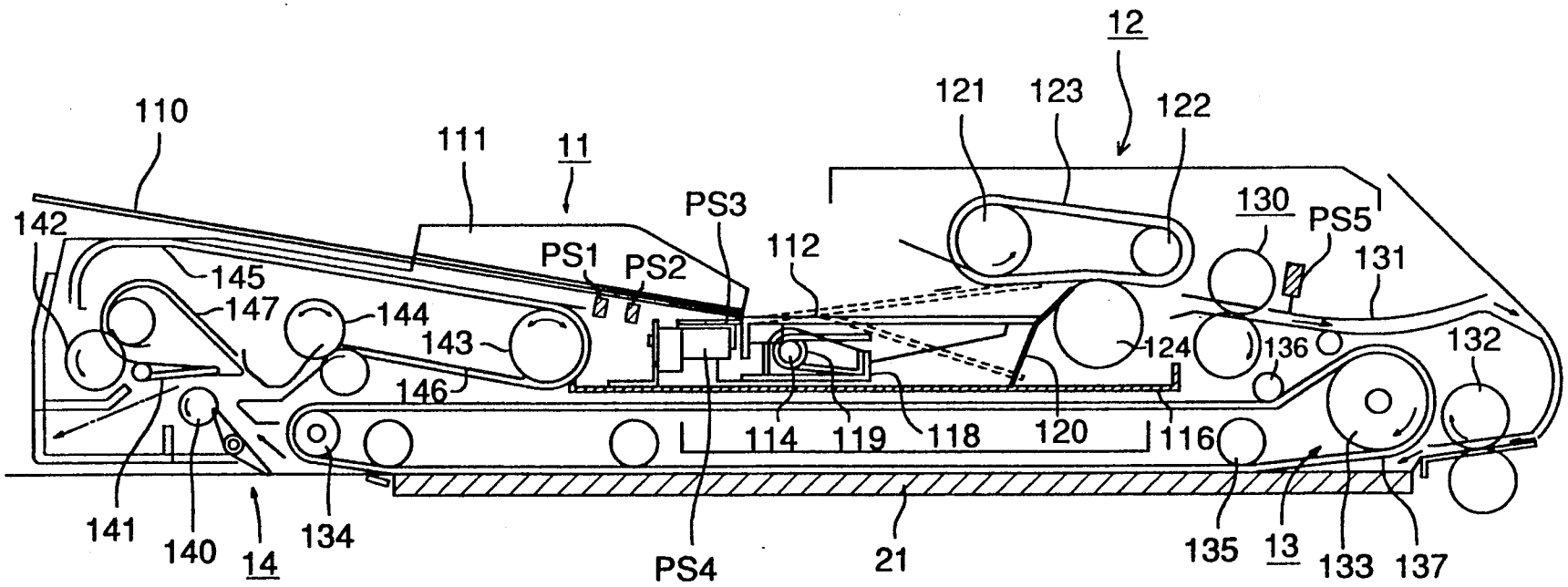
FIG. 2 is a sectional view of an automatic document feeder relating to the present invention.
Figure 3:
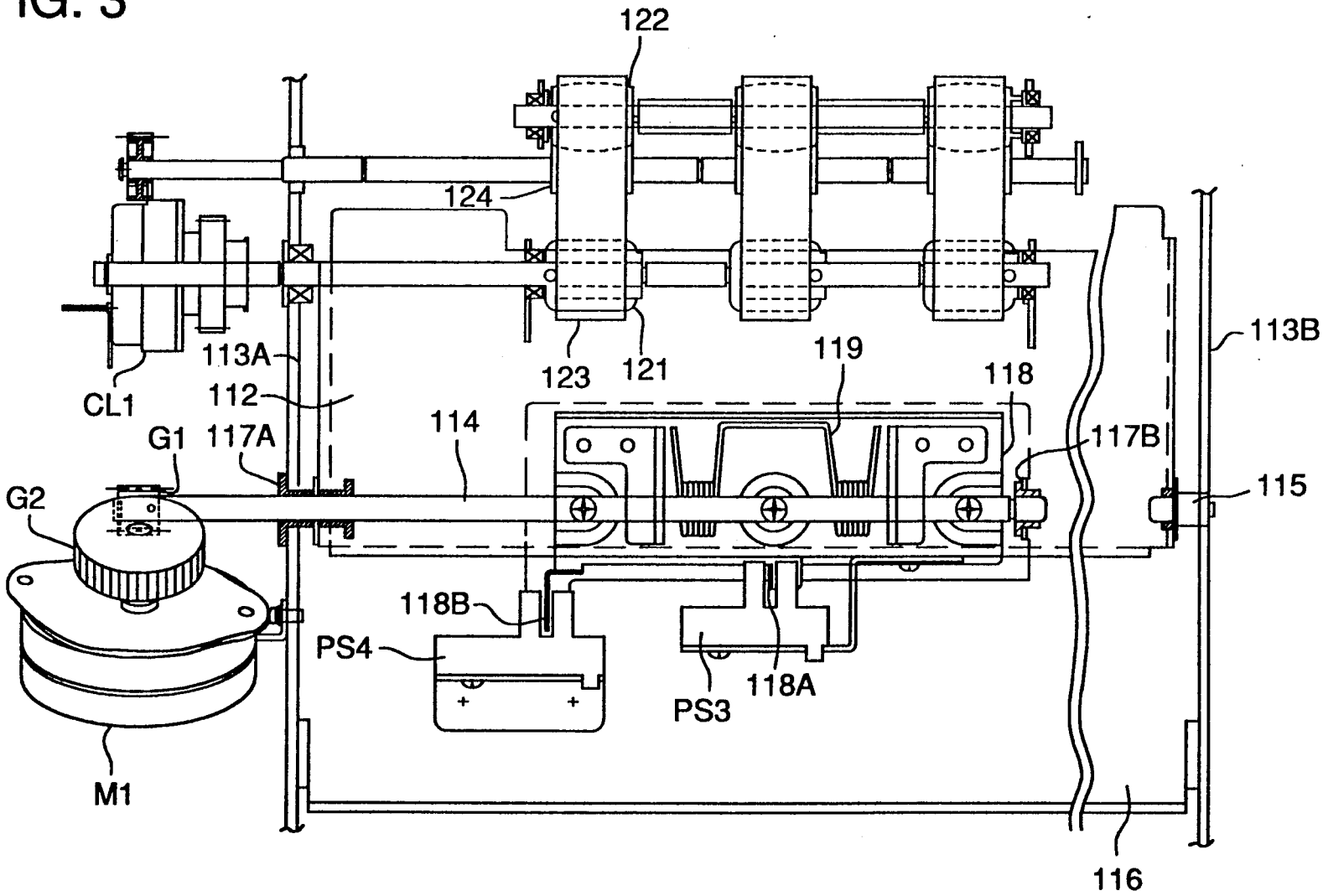
FIG. 3 is a partial plan view of the aforementioned automatic document feeder.
Figure 4:
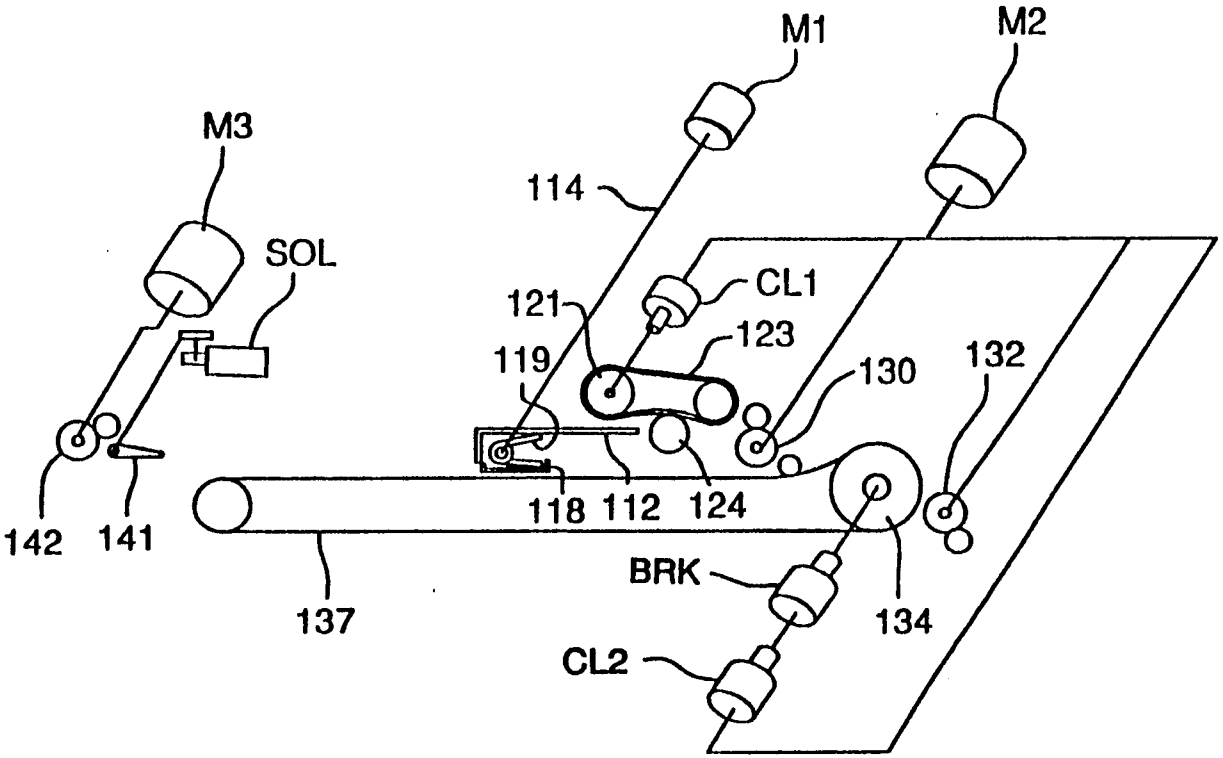
FIG. 4 is a schematic illustration showing a model of a drive system of the aforementioned automatic document feeder.

FIG. 2 is a sectional view of an automatic document feeder relating to the present invention, FIG. 3 is a partial plan view of the automatic document feeder, and FIG. 4 is a schematic illustration showing the structure of the drive system (power transmission system) of the automatic document feeder.

As shown in FIG. 1, the automatic document feeder 10 is mounted on the copier body 1. The automatic document feeder 10 includes a document stack section 11 on which a stack of documents are loaded, a paper feeding section 12 that separates a sheet of document D from the stack to feed it, a conveyance section 13 that conveys document D fed by the paper feeding section 12, to a predetermined position on a platen glass 21, and a discharged paper reversing section 14 that discharges document D conveyed by the conveyance section 13 onto a paper discharge tray, and at the same time reverses a document that has already been exposed, and conveys it onto the platen glass 21.

The document stack section 11 is provided with a document stack tray 110 on which documents are stacked. On the document stack tray 110, a lateral width regulation plate 111 is movably provided so as to regulate the movement of documents.

When a stack of documents D are placed on the stack tray 110, they are detected by document detection sensor PS1, and ADF mode is displayed on a control panel of the copier body 1. In this case, document detection sensor PS1 is a sensor capable of detecting that there is no document on the stack tray 110. When the stack of documents D are placed in a predetermined position, the document size (B5 to A3) is detected by document size sensor PS2, and the result of the detection is inputted into the control section of the copier body 1.

Movable press plate (movable press member) 112 is disposed downstream of the stack tray 110 in the document flow direction. The movable press plate 112 is rotatably supported by an oscillating shaft 114 engaged with a bearing 117A provided onto one side plate 113A, and also supported by a pin 115 fixed on the other side plate 113B. Accordingly, the movable press plate 112 can be rotated around the aforementioned oscillating shaft 114 and the pin 115.

Both side plates 113A and 113B are integrally connected with a bottom plate 116. The oscillating shaft 114 penetrates through the bearing 117A provided on the side plate 113A, and the bearing 117B provided in a rising portion of the fixed bottom plate 116. Gear G1 is mounted on the end of this oscillating shaft 114, and engaged with gear G2 fixed to a drive shaft of motor M1 for pressing.

Drive plate (drive member) 118 is fixed to the oscillating shaft 114 by screws, so that the drive plate 118 can be oscillated integrally with the oscillating shaft 114. Resilient deformation member (for example, a torsion spring) 119 is wound around the oscillating shaft 114, and both end portions of the deformation member 119 come into pressure contact with the drive plate 118, and the center portion of the deformation member 119 comes into pressure contact with the movable press plate 112. In this case, the movable press plate 112 and drive plate 118 are pushed by the torsion spring 119 so that they can be opened. However, the end portion of the movable press plate 112 is brought into contact with the drive plate 118, so that the distance between the movable press plate 112 and the drive plate 118 is restricted within a predetermined limit. The force of the torsion spring 119 is previously adjusted within an initial setting value described later.

Actuator portions (shading portions) 118A, 118B are protruded from the rear side of the drive plate 118 by folding the drive plate 118. The actuator portion 118A opens and closes an optical path of press detection sensor (for example, a photointerrupter) PS3 that is fixed to the movable press plate 112. The actuator portion 118B opens and closes an optical path of home position detection sensor (for example, a photointerrupter) PS4 that is fixed to the fixed bottom plate 116, so that the home position of the drive plate 118 is detected.

The paper feeding section 12 is disposed downstream of document feed of the movable press plate 112. The paper feeding section 12 is composed of document leading edge stopper 120, drive roller 121, idle roller 122, feed belt 123 around both rollers, and reverse roller 124 located below to prevent double feeding. The drive roller 121 is driven by drive motor M2 through magnetic clutch CL1.

Conveyance section 13 is provided on the downstream side of document conveyance of the paper feeding section 12. The conveyance section 13 includes first intermediate conveyance roller 130, document edge detection sensor PS5, curved guide plate 131, second intermediate conveyance roller 132, and conveyance belt 137 around the drive roller 133, idle roller 134, three document feed rollers 135, and tension roller 136.

The shaft of the drive roller 133 is connected with clutch CL2 and brake BRK, and the drive roller 133 is rotated by drive motor M2.

The discharge paper reversing section 14 includes a discharge paper roller 140, changeover claw 141, a plurality of conveyance rollers 142, 143, 144, and guide plates 145, 146, 147. The discharge paper roller 140 and conveyance rollers 142 to 144 are driven by discharge paper motor M3, and the changeover claw 141 is driven by solenoid SOL.

The one-dotted chain line shown in FIG. 2 shows a conveyance passage of document D discharged from the discharge paper reversing section 14 onto a discharge paper tray 148 disposed outside of the apparatus.

Figure 5A:
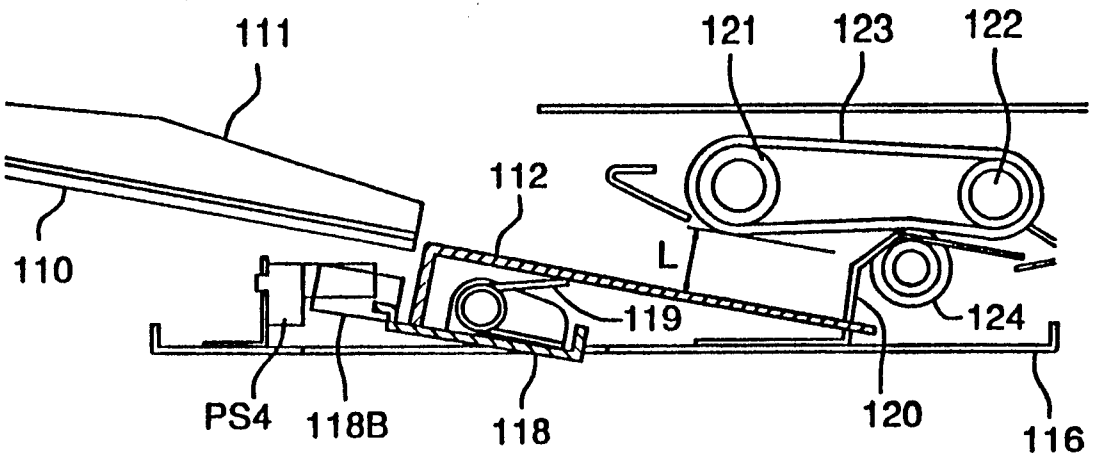
FIGS. 5(A) and 5(B) are sectional views of a document stacker and a paper feeding section of the aforementioned automatic document feeder.
Figure 5B:
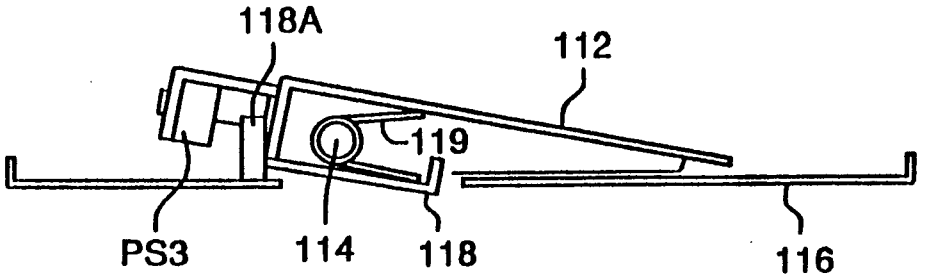
Figure 6:
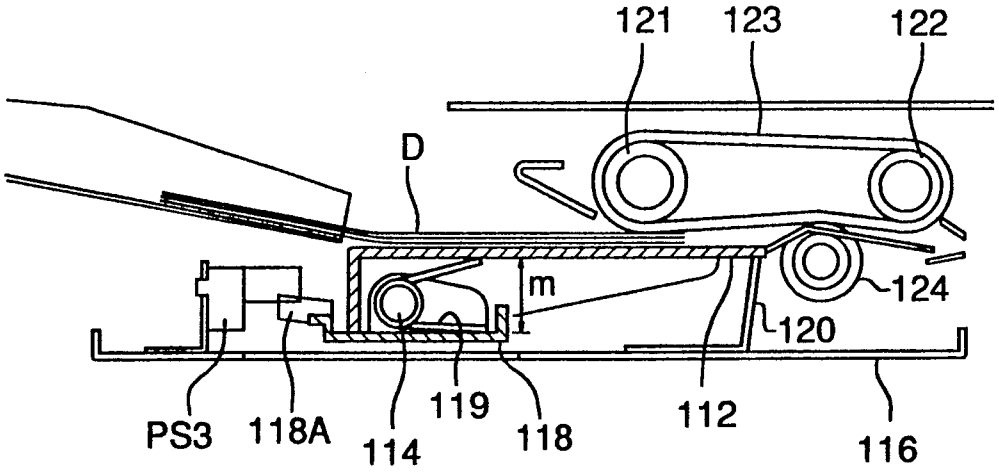
FIG. 6 is a sectional view showing progress of an operation of the press means of the paper feeding device of the present invention.
Figure 7:
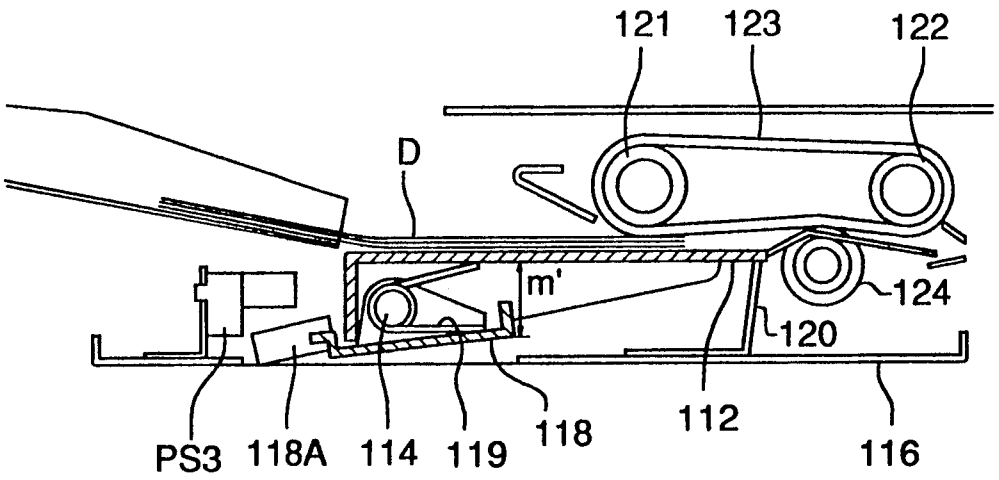
FIG. 7 is a sectional view showing the paper feeding device that is in a condition of paper feeding.
Figure 8:
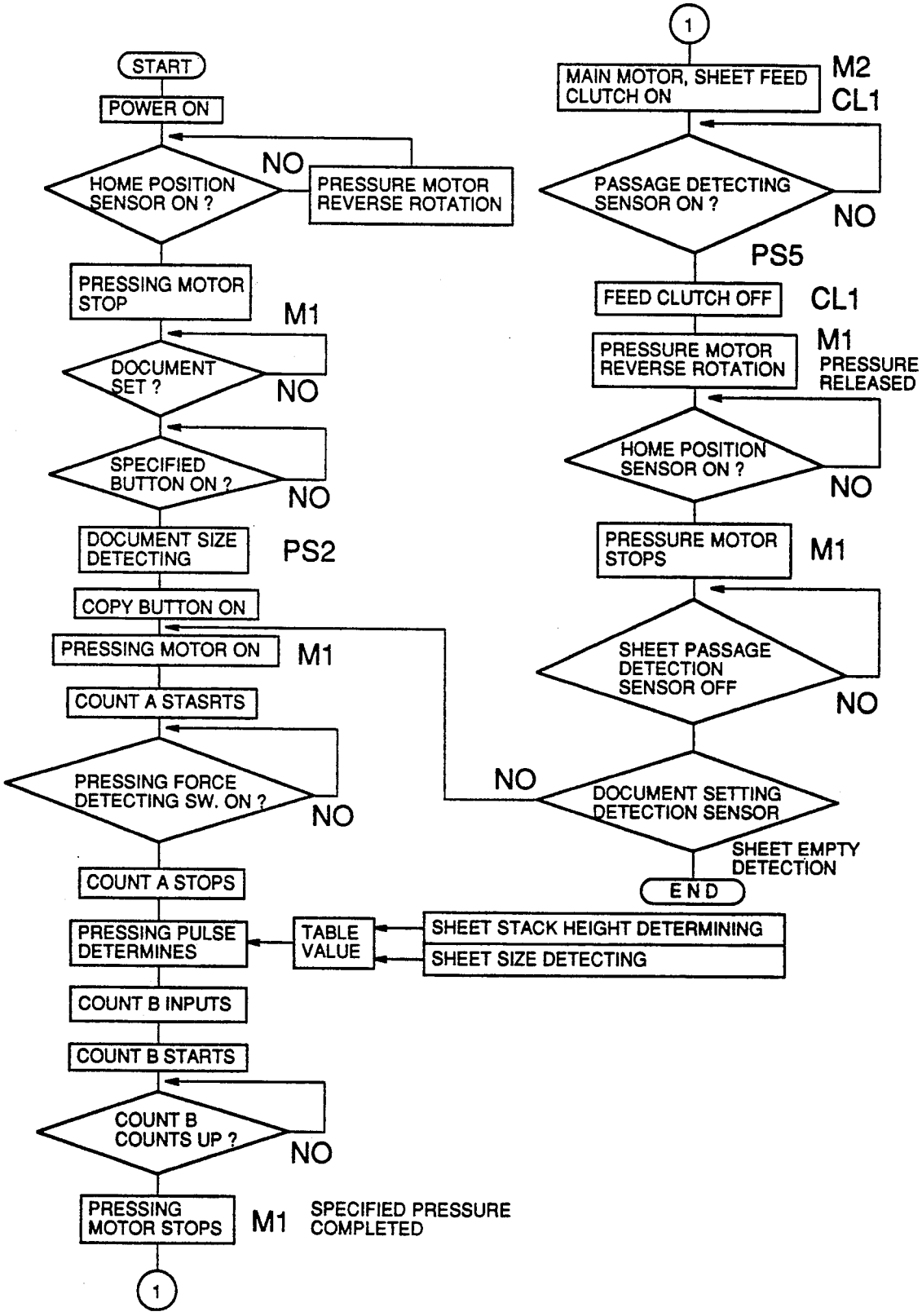
FIG. 8 is a flow chart showing the progress of paper feeding of the aforementioned paper feeding device.
Figure 9:
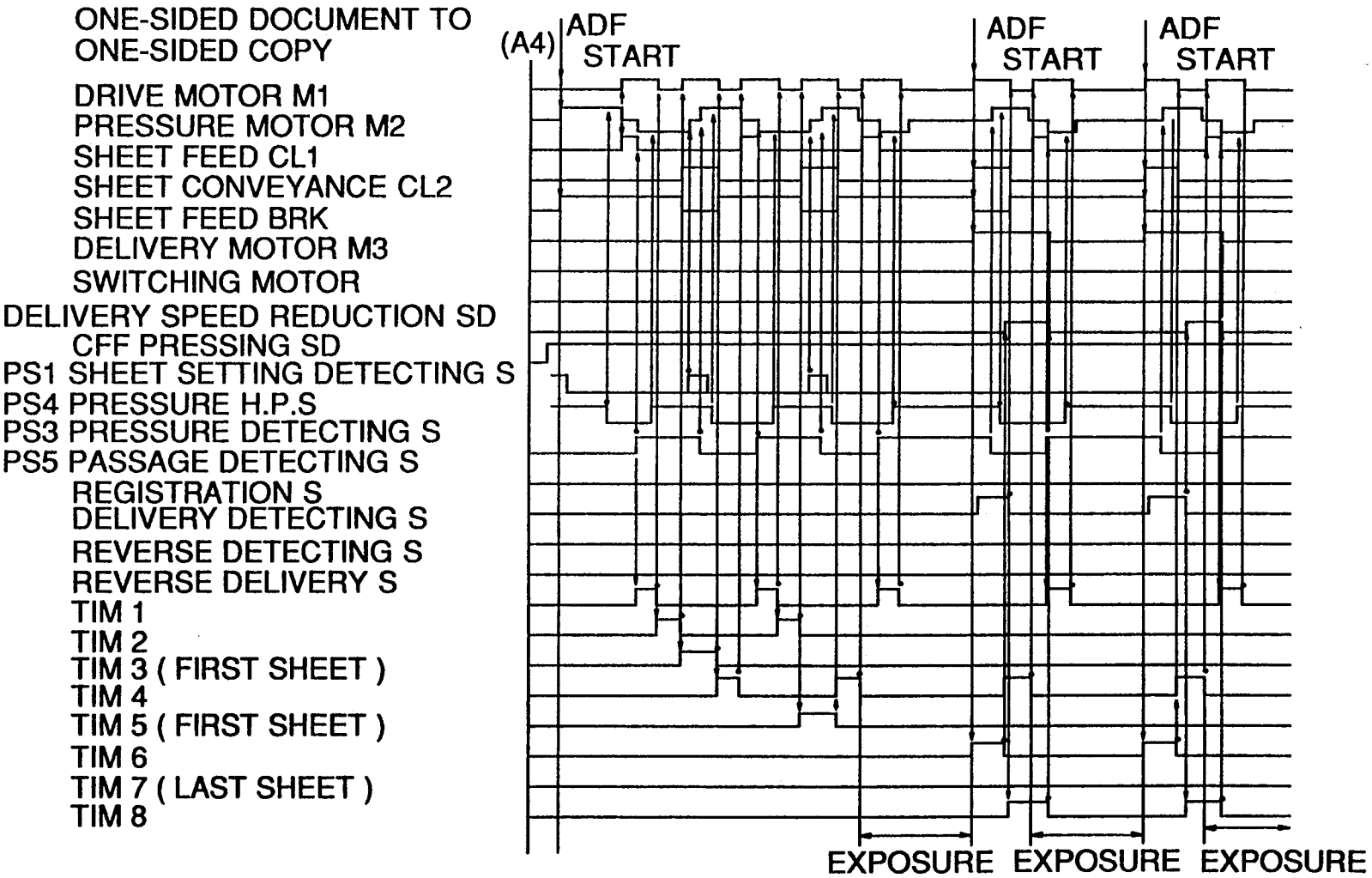
FIG. 9 is a timing chart of the aforementioned paper feeding device.

FIGS. 5(A) and 5(B) are sectional views of the document stack section 11 and paper feeding section with no documents. FIG. 5(A) is a sectional view in which home position detection sensor PS4 is located in the center. FIG. 5(B) is a sectional view in which press sensor PS3 is located in the center. FIG. 6 is a sectional view showing document stack D placed on the document stack section 11 and movable press plate 112 being driven. FIG. 7 is a sectional view of the paper feed section 12 that is ready to feed papers. FIG. 8 is a flow chart showing the paper feeding progress of the paper feeding unit. FIG. 9 is a timing chart showing the paper feeding progress. Paper feeding operations are explained as follows.

(1) When the main switch of the copier body 1 is turned on under the condition shown in FIGS. 5(A), motor M1 for pressing is driven, and the initial stop position of the movable press plate 112 is detected by home position detection sensor PS4, wherein motor M1 for pressing is stopped. That is, home position detection sensor (the second detection member) PS4 is turned on in the home position. In the case where the main switch is turned on and home position detection sensor PS4 is turned off, motor M1 is reversed, and when it is detected that home position detection sensor PS4 has been turned on, motor M1 for pressing is stopped, and the drive plate 118 and movable press plate 112 are stopped at the initial position. In the case where home position detection sensor PS4 is turned on, motor M1 for pressing is normally rotated for a moment so that home position detection sensor PS4 is turned off, and then motor M1 is reversed. After sensor PS4 has been turned on, motor M1 is stopped and the movable press plate 112 is set at the home position. This operation is effective for absorbing the time lag of drive gears and sensors. When the movable press plate 112 is set at the home position, clearance L is maintained in which the maximum amount of document stack D can be accommodated.

(2) When document stack D is placed on the stack tray 110 and the movable press plate 112, document set detection sensor PS1 is turned on and the device is set at the ADF mode. At the same time, document size sensor PS2 is turned on and the document size is detected. (Refer to FIGS. 2 and 8.)

(3) When the copy button is pressed, ADF operations can be started, so that copy operations can be started. Then, motor M1 (stepping motor) for pressing is rotated, so that the movable press plate 112 is oscillated through the drive member 118 secured to the oscillating shaft 114 and through the spring 119. The tip of the movable press plate 112 is raised so that stacked documents D are lifted. While the movable press plate 112 is being raised, the rotational angle of the oscillating shaft 114 is measured in such a manner that an rotary encoder counts pulse count A. (Refer to FIGS. 6 and 7.)

(4) When the upper surface of documents D stacked on the movable press plate 112 comes into contact with the outer circumferential surface of the feed belt 123, the movable press plate 112 ceases holding the document stack. However, the drive plate 118 is further rotated counterclockwise compressing the torsion spring 119, so that distance m between the movable press plate 112 and the drive plate 118 is shortened (m→m').

(5) When distance m reaches a predetermined value, an actuator 118A provided on one end of the drive plate 118 turns on press detection sensor PS3 secured onto the movable press plate 112, so that the pressure reaches an initial setting value (for example, 50 g) and the operation of pulse count A is stopped.

(6) Thickness of stacked documents D is detected by the result of pulse count A. The specified pulse number is determined from Table 1 in accordance with the document size and thickness.

TABLE 1

| Press Force Setting Table | | | | | | | | |
|---|---|---|---|---|---|---|---|---|
| | | Paper of document | | | | | | |
| | | Size | | | | | Thickness | |
| Count A | | B5 | A4 | B4 | A3 | Mixed size | Thin paper | Thick paper |
| Thickness | Large | 10 | 12 | 15 | 17 | 14 | 10 | 18 |

TABLE 1-continued

| Press Force Setting Table | | | | | | | | |
|---|---|---|---|---|---|---|---|---|
| | | Paper of document | | | | | | |
| | | Size | | | | | Thickness | |
| Count A | | B5 | A4 | B4 | A3 | Mixed size | Thin paper | Thick paper |
| of documents | Middle | 8 | 10 | 13 | 15 | 12 | 8 | 16 |
| | Small | 6 | 8 | 11 | 13 | 10 | 6 | 14 |

Remark: Each number shows specified pulse number B.

The thickness of stacked documents is detected by the counted value of count A that is detected by press detection sensor PS3. In Table 1, this thickness of stacked documents is classified into three, that is, large, middle and small.

In Table 1, the document size is classified into B5 to A3. In the case where a plurality of document sizes are used, an operator pushes a mixed-size button.

Thickness of a document paper is designated when an operator presses a thin paper button or thick paper button disposed on the operation panel of the copier body.

As described above, the thickness and size of stacked documents are automatically detected with sensors, and when mixed sizes of documents are set, it is set manually, and further the paper thickness is also set manually.

The press force setting table shown in Table 1 is previously set when the aforementioned values are automatically set and manually set. The setting values are stored in a nonvolatile memory, and count B is determined by these sheet condition input means.

According to Table 1, which is a press force setting table, the larger the document size is, the larger count B (a setting table value) becomes, and the thicker the stacked documents are, the larger count B becomes, and also the thicker one document is, the larger count B becomes. In the case where a plurality of sizes of documents are stacked on the stack tray all together, count B is set under the condition that the documents are of the middle size between B5 and A3.

According to the input signal sent by the aforementioned sheet condition input means, the drive means is adjustably controlled by the control means. That is, in the case where it is inputted that a document D stacked on the stack tray 110 is thin, motor M1 for pressing is driven by the control means, and count control is conducted by the rotary encoder so that the drive plate 118 is moved and the movable press plate 112 is raised. Therefore, the stacked documents are pressed by a predetermined pressure in which count B value is small, so that the document is positively fed and damage to the document can be prevented. This predetermined pressure is variably controlled according to the thickness of the stacked documents.

In the case where thin document papers are set, the speed of drive motor M2 is reduced, and the speed of the feed belt 123 and that of the intermediate conveyance rollers 130, 132 are reduced so that the feed speed of document D is lowered. In this way, the thin papers are stably fed, and the occurrence of double feeding and jamming can be prevented.

In the case where it is inputted into the sheet condition input means that document D is thick, a large value of count B is set by the control means, and the movable press plate 112 is pressed against the stacked documents on the stack tray 110 at a predetermined high pressure.

Alternatively, the paper feeding speed of the paper feeding device is lowered by the control means.

In the case where a plurality of sizes of documents D are loaded on the stack tray 110, it is inputted with the button provided on the operation panel of the sheet condition input means. Then, irrespective of a document size detection signal, a predetermined press force of the movable press plate 112 is selected and set. According to the thickness of stacked documents, count B is selected in Table 1, and the predetermined pressure is variably controlled.

(7) According to the sheet size detection signal or the sheet condition input signal, count B is inputted by a designated pulse, and further when the drive plate 118 is driven, a counting operation of count B is started. When the drive plate 118 is oscillated until the number of count reaches the designated count B, the winding amount of the torsion spring 119 is increased, so that the resilient force is approximately linearly increased and the press force is increased.

(8) When count B is counted up, the movable press plate 112 presses document D against the feed belt 123 with a predetermined press force (for example, 100 g). After that, motor M1 for pressing is stopped.

(9) Next, drive motor (main motor) M2 is turned on, and at the same time, electromagnetic clutches CL1 and CL2 are also turned on so that a paper feeding operation is started.

That is, upper documents D are conveyed out by the feed belt 123 rotated by motor M2, and only the uppermost document is separated from the documents by the reverse roller, and the separated uppermost document is conveyed.

The aforementioned separated document D is conveyed by the intermediate roller 130, and when the leading edge of the document is detected by document edge detection sensor PS5, clutch CL1 that has been driving the drive roller 121 is turned off, so that the feed belt 123 is stopped after it has idly rotated until the trailing edge of document D passes through sensor PS3.

(11) When document edge detection sensor PS5 is turned on, motor M1 for pressing is reversed, and the drive plate 118 and the movable press plate 112 are lowered, so that the pressing motion is released.

(12) When home position detection sensor PS4 detects that the drive plate 118 has returned to the initial position, motor M1 for pressing is stopped. Alternatively, the drive plate 118 and the movable press plate 112 are not returned to the home positions, and stopped in the middle of movement in accordance with the detection signal of press detection sensor (the first detection member) PS3 or the drive start signal of the drive means.

(13) After the trailing end of the first document D has passed and document edge detection sensor PS5 has been turned off, the pressing operation of the following document is started and the pressing condition is maintained until the next feeding operation is started. Alternatively, the pressing operation of the drive means is started in accordance with the detection signal, so that the drive plate 118 and the movable press plate 112 are lifted and the successive document is pressed.

Figure 10:
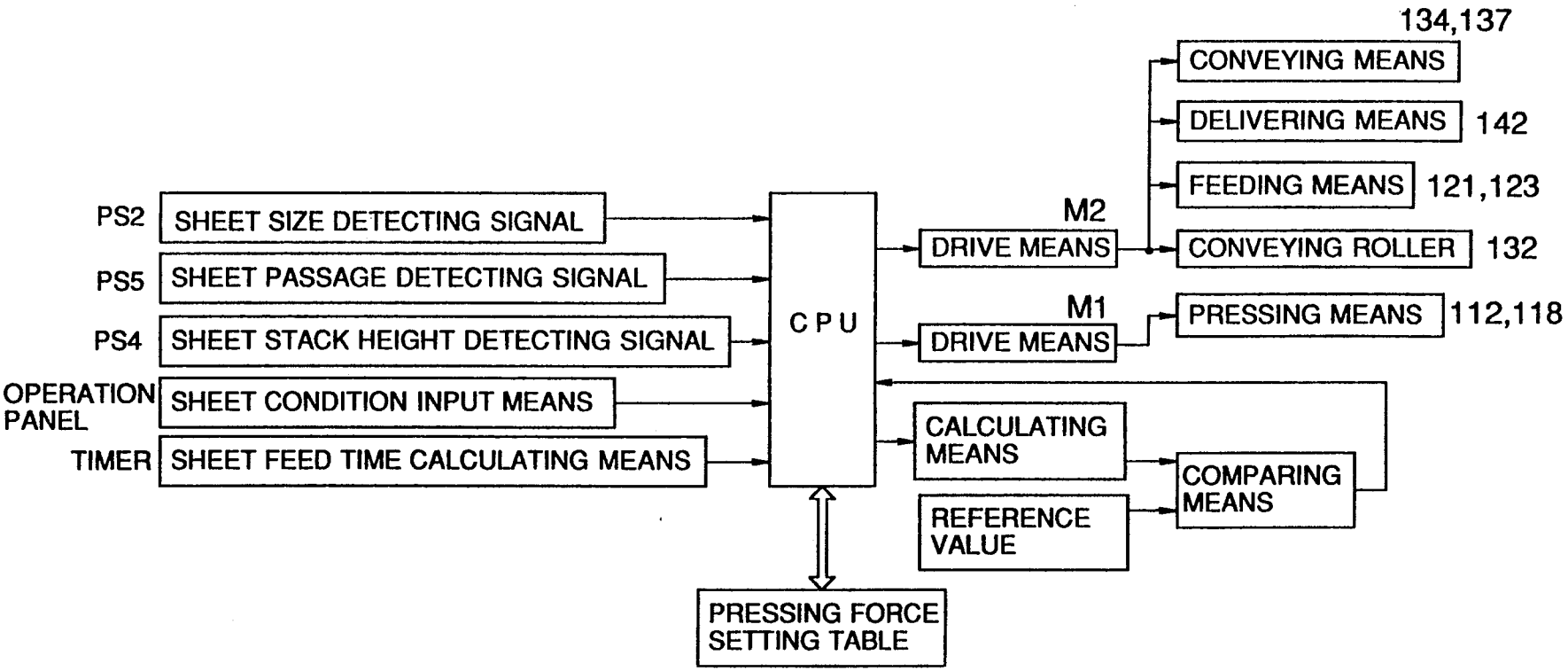
FIG. 10 is a control block diagram of another example of the paper feeding device of the present invention.

With reference to FIG. 2 and FIG. 10, which is a control block diagram, another example of the sheet feeding device of the present invention is explained as follows.

In this example, operations are carried out as follows. After the start of oscillation of the drive plate 118, the field belt 123 is rotated so as to start the feeding operation. From this point of time, a measurement operation is started by the measurement means of a timer or an encoder, so that the period of time is measured from the start of measurement to the passing of the leading edge of a document detected by document edge detection sensor PSS. The measurement value is compared with the reference value that has been previously set. When there is a difference larger than a predetermined value, the press force of the press means is changed in the next processing, or the sheet feeding speed is changed. There is a possibility that the aforementioned difference of time causes the following problems. That is, a long period of time exceeding a predetermined value is required because of slippage of documents and defective separation of documents caused by a change of the frictional coefficient of the surface of the feed belt 123. In order to prevent the aforementioned problems, after the detection by the comparison means, the detection signal is fed back to the control unit so that the pressing force can be automatically increased in the successive operation or the sheet feeding speed can be automatically lowered.

Figure 11A:
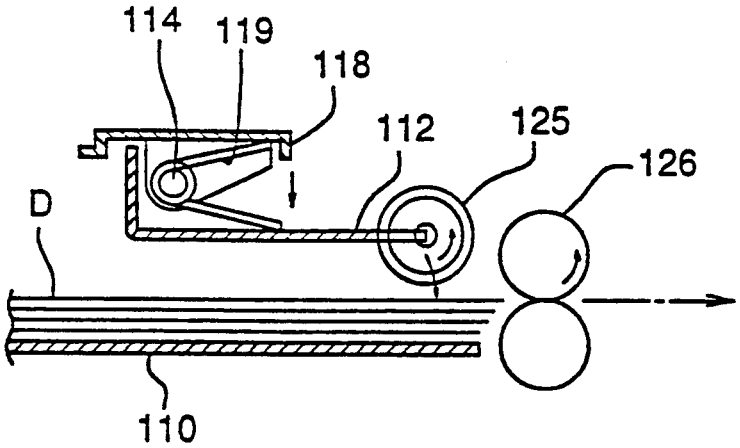
FIGS. 11(A) and 11(B) are sectional views of an essential portion of another example of the paper feeding device of the present invention.
Figure 11B:
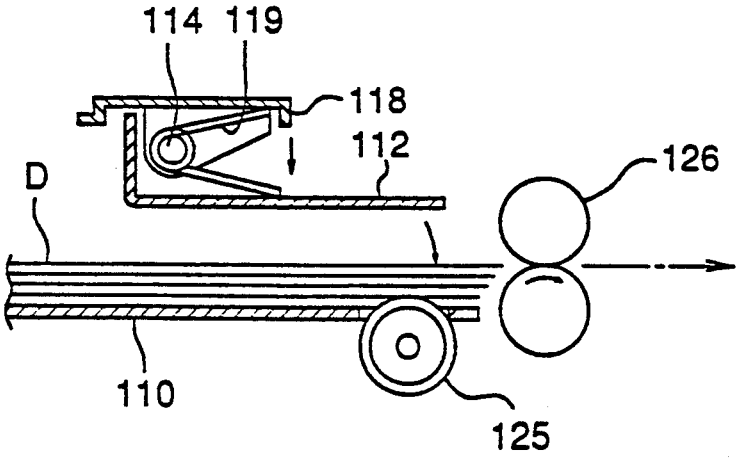
Figure 11C:
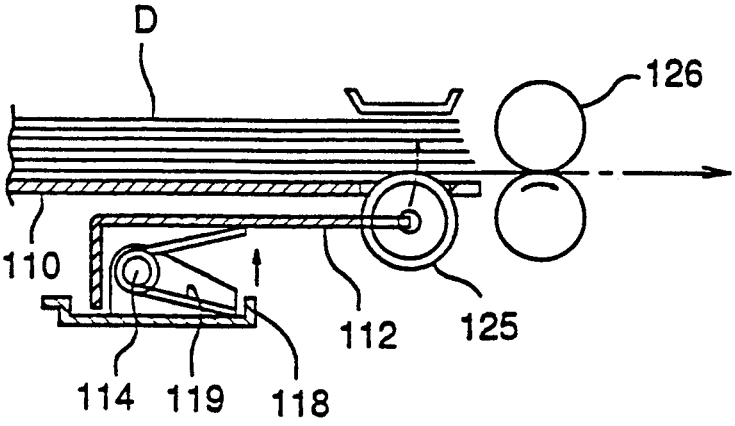

FIGS. 11(A), 11(B) and 11(C) are sectional views showing the essential portions of an example of another press mechanism of the sheet feeding device of the present invention. Like parts in each of the figures of the aforementioned example and this example are identified by the same reference character, and only different points are explained here.

With reference to FIG. 11(A), the structure of this example will be explained as follows. The upper conveyance feeding roller 125, which is rotated by a drive means, is supported by the movable press plate 112 and disposed above document stack D. In the same manner as the aforementioned example, the movable press member 112 is pressed against the upper surface of document stack D with a predetermined pressing force by the action of the drive plate 118 oscillated by the oscillating shaft 114 driven by motor M1 and also by the action of the torsion spring 119. Document D conveyed out from the stack by the upper conveyance roller 125 is separated from others by the separation means 126 to prevent double feeding, so that only one sheet can be fed.

FIG. 11(B) shows a bottom conveyance sheet feeding device. Above the stack tray 110, is provided a press means including the movable press plate 112, drive plate 118, torsion spring 119 and oscillating shaft 114. The press means presses the stack of documents D with a predetermined pressure. The feeding roller 125 disposed downward sends a lower document D to the separation means 126.

FIG. 11(C) also shows a bottom conveyance sheet feeding device. In this example, the press means is disposed downward. The feeding roller 125 provided in the tip of the movable press plate 112 sends a document to the separation means 126.

The press force generated by the press means explained above can be automatically changed according to the document size, width and thickness. The press force can be manually changed when the operator designates the conditions.

In the aforementioned examples, the pressing operation is released each time when the press means is returned to the home position. However, the press means may be always contacted with documents until all the documents are sent out. Alternatively, the release may be returned by a predetermined amount.

Since the sheet feeding device of the present invention is structured in the way explained above, the following effects can be provided.

When the sheets stacked on a stack tray are fed, the sheets are pressed by a press means. At that time, the pressing force can be automatically changed in accordance with the sheet size, the thickness, and the number of sheets. Consequently, the sheets can be stably conveyed.

The sheet pressing force can be changed almost continuously. Therefore, sheet conveyance can be stably carried out in all sheet feeding conditions.

Sheets can be smoothly fed at high speed without any problems.

According to the present invention, a large-scale mechanism such as a suction sheet feeding device is not necessary, and noises are not caused.

What is claimed is:

1. A sheet feeding device having a tray on which a plurality of sheets are stacked in a stack, feeding means for feeding said sheets stacked in said stack by contact therewith, separation means provided downstream of said feeding means in a downstream feeding direction, for separating said stacked sheets, one by one, from said stack, and at least one pair of conveyance rollers provided downstream of said separation means, in said downstream feeding direction, for conveying each of said separated sheets, said sheet feeding device further comprising:

(a) size detection means for detecting a size of said sheets in said stack, and for generating a size detection output signal indicative of the detected size of said sheets in said stack;

(b) pressing means for adjustably pressing said sheets in said stack so that a contact pressure between said feeding means and said sheets in said stack is adjustable based on said output signal from said size detection means;

(c) sheet edge detecting means provided downstream of said separation means, in said downstream feeding direction, for detecting an edge portion of each of said separated sheets;

(d) first and second driving means for driving said feeding means, said pressing means and said at least one pair of conveyance rollers;

(e) control means for controlling said first and second driving means; and (f) a table including a plurality of variable and selectable pressure forces that are appliable by said pressing means and which are set in said table in accordance with said output signal of said size detection means; and wherein said control means controls at least one of said first and second driving means to vary at least one of a speed of said feeding means, a pressure provided by said pressing means and a movement of said at least one pair of conveyance rollers based on a value set in said table that is selected based on said size detection output signal from said size detection means.

2. The sheet feeding device of claim 1, further comprising:

thickness detection means for detecting a thickness of said stack; and wherein said table includes:

a plurality of selectable and variable pressure forces set in said table which vary in accordance with said size detection output signal of said size detection means, and a thickness of said stack detected by said thickness detection means; and a pressure force value set in said table so that a pressure exerted by said pressing means increases in accordance with at least one of an increase in said size of said sheets and an increase in a thickness of said stack.

3. A sheet feeding device having a tray on which a plurality of sheets are stacked in a stack, feeding means for feeding said sheets stacked in said stack by contact therewith, separation means provided downstream of said feeding means in a downstream feeding direction, for separating said stacked sheets, one by one, from said stack, and at least one pair of conveyance rollers provided downstream of said separation means, in said downstream feeding direction, for conveying each of said separated sheets, said sheet feeding device further comprising:

(a) setting means for setting a plurality of characteristics of said sheets before a sheet feeding is started and for generating a setting means output signal;

(b) size detection means for detecting a size of said sheets in said stack, and for generating a size detection output signal indicative of the detected size of said sheets in said stack;

(c) pressing means for applying an adjustable pressure to said sheets in said stack so that a contact pressure between said feeding means and said stack is adjustable based on said size detection output signal from said size detection means;

(d) sheet edge detecting means provided downstream of said separation means, in said downstream feeding direction, for detecting an edge portion of each of said separated sheets;

(e) first and second driving means for driving said feeding means, said pressing means and said at least one pair of conveyance rollers; and (f) control means for controlling said first and second driving means; and wherein:

(g) said control means controls at least one of said first and second driving means in accordance with said setting means output signal.

4. The sheet feeding device of claim 3, wherein:

when said setting means sets a characteristic related to a predetermined thickness of sheets to be stacked in said stack; and when a signal is input to said control means that indicates that a thickness of sheets actually being stacked in said stack is less than said predetermined thickness;

then, said control means controls said adjustable pressure applied by said pressing means to be lower than a pressure that would be applied by said pressing means if sheets having said predetermined thickness were in said stack.

5. The sheet feeding device of claim 3, wherein:

when the setting means sets a characteristic related to a predetermined thickness of sheets to be stacked in said stack; and when a signal is input to said control means that indicates that a thickness of sheets actually being stacked in said stack is greater than said predetermined thickness;

then, said control means controls a feeding speed of at least said feeding means to a be a value lower than a feeding speed that would be used if sheets having said predetermined thickness were in said stack.

6. The sheet feeding device of claim 3, wherein:

when said setting means sets a characteristic related to a predetermined thickness of sheets to be stacked in said stack; and when a signal is input to said control means that indicates that a thickness of said sheets actually being stacked in said stack is greater than said predetermined thickness;

then, said control means controls said adjustable pressure applied by said pressing means to be set to a value higher than a pressure that would be applied by said pressing means if sheets having said predetermined thickness were in said stack.

7. The sheet feeding device according to claim 3, wherein:

when the setting means sets a characteristic related to a predetermined thickness of sheets to be stacked in said stack; and when a signal is input to said control means that indicates that a thickness of sheets actually being stacked in said stack is less than said predetermined thickness;

then, said control means controls a feeding speed of at least said feeding means to be a value lower than a feeding speed that would be used if sheets having said predetermined thickness were stacked in said stack.

8. The sheet feeding device of claim 3, wherein:

when the setting means sets a characteristic related to a plurality of conditions under which a plurality of different size sheets are stacked in said stack; and when a signal is input to said control means that indicates said conditions;

then, said control means controls said adjustable pressure applied by said pressing means to be set to a predetermined value irrespective of said size detection output signal from said size detection means.

9. The sheet feeding device of claim 3, wherein:

when the setting means sets a characteristic related to a plurality of conditions under which a plurality of different sizes of sheets are stacked in said stack; and when a signal is input to said control means that indicates said conditions;

then, said control means controls a feeding speed of at least said feeding means to be set to a value lower than a feeding speed that would be used if all sheets in said stack had a common size.

10. A sheet feeding device having a tray on which a plurality of sheets are stacked in a stack, feeding means for feeding said sheets stacked in said stack by contact therewith, separation means provided downstream of said feeding means in a downstream feeding direction, for separating said stacked sheets, one by one, from said stack, and at least one pair of conveyance rollers provided downstream of said separation means, in said downstream feeding direction, for conveying each of said separated sheets, said sheet feeding device further comprising:

(a) size detection means for detecting a size of said sheets in said stack, and for generating a size detection output signal indicative of the detected size of said sheets in said stack;

(b) pressing means for adjustably pressing said sheets in said stack so that a contact pressure between said feeding means and said sheets in said stack is adjustable based on said size detection output signal from said size detection means;

(c) sheet edge detecting means provided downstream of said separation means, in said downstream feeding direction, for detecting an edge portion of each of said separated sheets;

(d) first and second driving means for driving said feeding means, said pressing means and said at least one pair of conveyance rollers;

(e) control means for controlling said first and second driving means;

(f) measuring means for measuring a time period between a start of a sheet feeding operation and a time when a leading edge of a sheet is detected by said sheet edge detecting means; and (g) comparing means for comparing the time period measured by said measuring means with a preset reference time period; and wherein:

when a difference of the time periods compared by said comparing means exceeds a predetermined value, a pressing force of said pressing means that is applied to a subsequently fed sheet is changed.

11. A sheet feeding device comprising:

(a) a tray on which a plurality of sheets are stacked in a stack;

(b) feeding means for feeding the sheets in said stack by a contact therewith;

(c) a movable member provided at part of said tray, for holding and pressing the sheets toward said feeding means by a moving operation of said movable member;

(d) an elastic member coupled to a drive member;

(e) said drive member moving said movable member through said elastic member;

(f) driving means for driving said drive member toward said elastic member;

(g) a first detection member for detecting at least one of a deformation amount of said elastic member and a relative position between said movable member and said drive member when said drive member is moved through said elastic member;

(h) separation means provided downstream of said feeding means, in a downstream feeding direction, for separating said sheets, one by one, from the stack;

(i) a second detection member provided downstream of said separation means, in said downstream feeding direction, for detecting an edge portion of a separated sheet; and (j) control means for controlling said feeding means and said driving means by controlling at least one of a feeding operation of said feeding means and a driving operation of said driving means to control a movement of sheets through said sheet feeding device.

12. A sheet feeding device comprising:

(a) a tray on which a plurality of sheets are stacked in a stack;

(b) feeding means for feeding the sheets in said stack by a contact therewith;

(c) a movable member provided at part of said tray, for holding the sheets and for pressing said feeding means toward the sheets by a moving operation of said movable member;

(d) an elastic member coupled to a drive member;

(e) said drive member moving said movable member through said elastic member;

(f) driving means for driving said drive member toward said elastic member;

(g) a first detection member for detecting at least one of a deformation amount of said elastic member and a relative position between said movable member and said drive member when said drive member is driven through said elastic member by said driving means;

(h) separation means provided downstream of said feeding means, in a downstream feeding direction, for separating said sheets one by one from the stack;

(i) at least a pair of conveyance rollers provided downstream of said separation means, in said downstream feeding direction, for conveying the sheets separated by said separation means;

(j) a second detection member provided downstream of said separation means, in said downstream feeding direction, for detecting an edge portion of a separated sheet; and (k) control means for controlling said feeding means, said driving means and said conveyance rollers, for controlling a movement of sheets through said sheet feeding device.

13. The sheet feeding device of claim 12, wherein said elastic member comprises a spring having an elastic force characteristic that varies linearly.

14. The sheet feeding device of claim 12, wherein said driving means comprises a motor.

15. The sheet feeding device of claim 12, wherein said first detection member comprises means for detecting at least one position between said pressing means and said drive member.

16. The sheet feeding device of claim 12, wherein said control means comprises means for setting a distance of travel of at least one of said driving means, said drive member and said movable member.

17. The sheet feeding device of claim 12, wherein said control means comprises means for setting an adjustable distance of travel of one of said driving means, said drive member and said movable member.

18. The sheet feeding device of claim 12, wherein said control means comprises means for setting a distance of travel of one of said driving means, said drive member and said movable member, and the setting of said distance of travel is set in said control means based on a plurality of pulses output from a stepping motor coupled to said control means.

19. The sheet feeding device of claim 12, further comprising:

an encoder member provided at a position between said driving means and said movable member, said encoder member comprising a plurality of slits; and a third detection member for detecting said slits of said encoder member; and wherein a setting of a distance of travel of one of said driving means, said drive member and said movable member is set in said control means according to a number of slits detected by said third detection member.

20. The sheet feeding device of claim 12, wherein said control means comprises:

setting means for setting a period of time in said control means, said period of time set in said control means determining a distance of travel for each of said driving means, said drive member and said movable member.

21. A sheet feeding device having a tray on which a plurality of sheets are stacked in a stack, feeding means for feeding said sheets stacked in said stack by contact therewith, separation means provided downstream of said feeding means in a downstream feeding direction, for separating said stacked sheets, one by one, from said stack, and at least one pair of conveyance rollers provided downstream of said separation means, in said downstream feeding direction, for conveying each of said separated sheets, said sheet feeding device further comprising:

(a) a rotation member in said feeding means for feeding sheets from said stack;

(b) a pressing member for pressing the sheets toward said rotation member;

(c) a drive member arranged for moving said pressing member;

(d) an elastic member coupled to a drive member;

(e) drive means for driving said drive member toward said elastic member;

(f) size detection means for detecting a size of said sheets in the stack;

(g) at least one first detection member for detecting a relative position between said pressing member and said drive member;

(h) control means for controlling a movement of said drive member;

(i) a second detection member for detecting a home position of said pressing member, said sheets being stacked between said rotation member and said pressing member;

(j) a third detection member for detecting an edge portion of a separated sheet; and (k) measuring means for measuring a distance travelled during a period of time that begins when one of a drive operation of said drive means and a detection operation by said second detection member occurs and ends at another time when a detection by said at least one first detection member occurs, and wherein a thickness of sheets stacked in said stack is detected based on a measured value of the distance travelled during said period of time.

22. A sheet feeding device having a tray on which a plurality of sheets are stacked in a stack, feeding means for feeding said sheets stacked in said stack by contact therewith, separation means provided downstream of said feeding means in a downstream feeding direction, for separating said stacked sheets, one by one, from said stack, and at least one pair of conveyance rollers provided downstream of said separation means, in said downstream feeding direction, for conveying each of said separated sheets, said sheet feeding device further comprising:

(a) a rotation member for feeding a sheet;

(b) an elastic member coupled to a drive member;

(c) a pressing member for pivotally holding said rotation member;

(d) said drive member pressing said pressing member through said elastic member;

(e) driving means for driving said drive member toward said pressing member;

(f) size detection means for detecting a size of said sheets in said stack;

(g) at least one first detection member for detecting a relative position between said pressing member and said drive member;

(h) control means for controlling a movement of said drive member;

(i) a second detection member for detecting a home position of the pressing member;

(j) a third detection member for detecting a trailing edge portion of a separated sheet; and (k) measuring means for measuring a distance travelled during a time period beginning when one of a drive operation of said driving means and a detection operative of said second detection member occurs and ending when a detection by said at least one first detection member occurs, and wherein a thickness of the sheets in said stack is detected based on a measured value of the distance travelled.

23. The sheet feeding device of claim 22, wherein said control means controls at least one of said feeding means, said driving means and said at least one pair of said conveyance rollers based on at least one of a thickness and a size of said sheets in said stack, to thereby control at least one of a feeding speed by said feeding means, a driving by said driving means and a movement of said conveyance rollers.

24. The sheet feeding device of claim 22, wherein a driving operation by said driving means is started in a direction which corresponds to a direction of movement of said drive member as said drive member moves away from said rotation member when a leading edge detection signal is provided by said third detection member that indicates that a leading edge portion of a separated sheet has been detected.

25. The sheet feeding device of claim 22, wherein a driving operation by said driving means is stopped in a direction which corresponds to a direction of movement of said drive member as said drive member moves away from said rotation member, said driving means being stopped based on one of a detection result of said first detection member and a single that indicates that a driving operation by said driving means has started.

26. The sheet feeding device of claim 22, wherein a driving operation by said driving means is started in a direction which corresponds to a direction of movement of said drive member as said drive member moves away from said rotation member, said driving means being started based on a detection signal provided by said third detecting member when a trailing edge of a separated sheet is detected.

27. A sheet feeding device having a tray on which a plurality of sheets are stacked, feeding means for feeding said sheets stacked in said stack by contact therewith, separation means provided downstream of said feeding means in a downstream feeding direction, for separating said stacked sheets, one by one, from said stack, and at least one pair of conveyance rollers provided downstream of said separation means, in said downstream feeding direction, for conveying each of said separated sheets, said sheet feeding device further comprising:

(a) pressing means for pressing said sheets in said stack so that a contact pressure is generated between said feeding means and said sheets in said stack;

(b) an elastic member coupled to said pressing means;

(c) a motor for moving said pressing means through said elastic member, said motor thereby changing said contact pressure;

(d) a press detection sensor for detecting a contact between said feeding means and said sheets in said stack; and (e) control means for controlling said contact pressure in accordance with a number of turns of said motor after said press detection sensor has detected said contact.

28. The sheet feeding device of claim 27, further comprising:

size detection means for detecting a size of said sheets in said stack, and for generating a size detection output signal that is indicative of the detected size of said sheets in said stack; and wherein said control means controls said motor based on said size detection output signal for said size detection means.

29. The sheet feeding device of claim 28, further comprising a table including a plurality of variable and selectable pressure forces that are appliable by said pressing means and which are set in said table in accordance with said size detection output signal of said size detection means.

30. The sheet feeding device of claim 27, wherein said press detection sensor further detects a thickness of said stack, and wherein said control means controls said contact pressure according to the detected thickness of said stack.

31. The sheet feeding device of claim 27, wherein:

a thickness of each of said sheets is manually designated; and a thickness signal indicative of said thickness of each of said sheets is provided to said control means so that said contact pressure is controlled by said control means based on said thickness signal.

32. The sheet feeding device of claim 31, further comprising:

an operation panel including a thin paper designating button and a thick paper designating button; and wherein said thickness is designated when an operator presses one of said thin paper designating button and said thick paper designating button.

* * * * *